US008414288B2

(12) United States Patent
Tzriker

(10) Patent No.: US 8,414,288 B2
(45) Date of Patent: Apr. 9, 2013

(54) COMBUSTION SYSTEM AND METHOD

(76) Inventor: Ilan Tzriker, Kfar Yona (IL)

( * ) Notice: Subject to any disclaimer, the term of this patent is extended or adjusted under 35 U.S.C. 154(b) by 652 days.

(21) Appl. No.: 12/610,390

(22) Filed: Nov. 2, 2009

(65) Prior Publication Data

US 2011/0104620 A1 May 5, 2011

(51) Int. Cl.
*F23L 7/00* (2006.01)

(52) U.S. Cl. ..... 431/2; 431/3; 431/4; 431/12; 123/3; 123/41.17; 123/64; 60/39.53; 60/39.55; 60/39.64

(58) Field of Classification Search ..... 60/39.53, 60/39.55, 39.64, 613; 431/2, 3, 4, 12; 123/3, 123/41.17, 64; 701/103
See application file for complete search history.

(56) References Cited

U.S. PATENT DOCUMENTS

| | | | | | |
|---|---|---|---|---|---|
| 877,194 | A | * | 1/1908 | Holzwarth | 60/39.22 |
| 1,339,176 | A | * | 5/1920 | Dyer | 123/25 R |
| 1,346,509 | A | * | 7/1920 | Olhovsky | 60/39.4 |
| 1,802,469 | A | * | 4/1931 | Hofmann | 60/775 |
| 2,853,995 | A | * | 9/1958 | Marks et al. | 126/110 E |
| 3,756,020 | A | | 9/1973 | Moskowitz et al. | |
| 3,782,107 | A | | 1/1974 | Bendall | |
| 4,308,487 | A | * | 12/1981 | Feaster | 315/58 |
| 4,924,823 | A | * | 5/1990 | Ogura et al. | 123/64 |
| 5,617,719 | A | | 4/1997 | Ginter | |
| 5,743,080 | A | | 4/1998 | Ginter | |
| 5,771,678 | A | | 6/1998 | Shouman | |
| 5,944,480 | A | | 8/1999 | Forrest | |
| 6,920,761 | B2 | * | 7/2005 | Laper | 60/772 |
| 7,891,185 | B2 | * | 2/2011 | Vuk | 60/608 |

FOREIGN PATENT DOCUMENTS

| | | |
|---|---|---|
| CN | 1061644 | 6/1992 |
| CN | 1891993 | 1/2007 |
| EP | 2107225 | 10/2009 |

* cited by examiner

*Primary Examiner* — Kenneth Rinehart
*Assistant Examiner* — Jorge Pereiro

(57) ABSTRACT

A combustion system comprising a combustion chamber fed by fuel and oxidant delivery lines. The oxidant line has an oxidant tank pressurized by a compressor. The fuel delivery line has a fuel source and a fuel feed mechanism. An ignition device ignites the oxidant and fuel mixture in the combustion chamber. The coolant line is adapted to inject cooling fluid directly into the combustion chamber. An energy production device is disposed downstream a combustion chamber exhaust valve for converting energy from both exhausted combustion gases and coolant gases exhausted from the combustion chamber. In some embodiments the coolant is the oxidant, while in other embodiments the coolant is another fluid introduced from a separate coolant delivery line.

10 Claims, 5 Drawing Sheets

COMBUSTION SYSTEM AND METHOD

FIELD OF THE INVENTION

The present invention relates to a combustion system and method, in particular wherein a combustion chamber is cooled by a fluid, typically air or vaporizing water, that is then used to produce additional energy.

BACKGROUND OF THE INVENTION

The combustion of fuel to produce energy is a well known technology. Regardless, research and development in this field continues as efficiency improvements are significant because much electricity is produced in this manner.

U.S. Pat. No. 5,743,080 and U.S. Pat. No. 5,617,719 disclose a high pressure vapor-air steam engine utilizing a working fluid consisting of a mixture of compressed un-combusted air components, fuel combustion products and steam. The working fluid is provided at constant pressure and temperatures in the cycle. Combustion air is supplied adiabatically by one or more stages of compression. Fuel is injected at pressure as needed. At least about 40% of the compressed air is burned. Inert liquid is injected at high pressure to produce steam and thus provide an inert high specific heat diluent vapor required for internal cooling of an internal combustion turbine or other type system. The use of extensive liquid injection inhibits the formation of pollutants, increases the efficiency and horsepower of an engine, and reduces specific fuel consumption. The cycle may also be operated open or closed; in the latter case, the liquid may be recouped via condensation for regenerative reuse. When salt water is injected into the system potable water is recovered from the steam exiting the power turbine and sterile sea salt is recovered from the combustion chamber.

U.S. Pat. No. 3,782,107 discloses an air-cooled rotary vane engine utilizing external and internal cooling air flow and a turbulence combustion chamber controlled by an automatic valve operated by the working fluid pressures. The engine is further constructed for operation with clearance sealing and dry internal lubrication.

U.S. Pat. No. 3,756,020 discloses a gas turbine engine and cooling system therefor. The stator vanes and rotor blades of a gas turbine engine are cooled internally by the circulation of a fluid coolant in a closed and sealed system. The heat absorbed from the blades and vanes by the coolant are extracted in a heat exchanger cooled by bleed air from the compressor, and the air thus heated then returns its heat load to the power cycle by being fed into the combustion chamber to take part in the combustion reaction. The engine is designed in such a manner that the turbine rotor with its blades and sealed internal cooling system, and the stator ring with its vanes and sealed internal cooling system, can be disassembled from the engine as units without breaking the sealed cooling system.

CN 1,891,993A discloses an internal combustion internal-cooled engine. The internal cooling method of the combustion engine mainly comprises: first, adding a water hole in the upper part of combustion chamber of an internal-combustion engine such as a four-stroke internal diesel combustion engine; second, during operation, as the piston reaches top dead point, an oil jetting is provided; third, as the piston moves down to make the crank corner be 27 deg., supplying water through the water hole to reduce the temperature in the cylinder, where the water absorbs heat and becomes steam so that its bulk is enlarged to push the piston to continue moving, and finally as the piston reaches bottom dead point, exhausting gas.

CN 1,061,644A discloses a method of cooling of an internal combustion engine. The cooling principle of the engine includes conducting cooling in the inner portion of the combustion chamber, water being the best cooling agent, for achieving the best cooling results. The timing, quantitative, fixed pressure and fixed position controls must be implemented to the cooling agent.

SUMMARY OF THE INVENTION

The present invention relates to a combustion system and method, in particular wherein a combustion chamber is cooled by a fluid, typically air or vaporizing water, that is then used to produce additional energy.

The combustion system comprises a combustion chamber fed by fuel and oxidant delivery lines. The oxidant line has an oxidant tank pressurized by a compressor. The fuel delivery line has a fuel source and a fuel feed mechanism. An ignition device ignites the oxidant and fuel mixture in the combustion chamber. An energy production device is disposed downstream a combustion chamber exhaust valve for converting energy from both exhausted combustion gases and coolant gases exhausted from the combustion chamber. The coolant line is adapted to inject cooling fluid directly into the combustion chamber. In some embodiments the coolant is the oxidant, while in other embodiments the coolant is another fluid introduced from a separate coolant delivery line.

In accordance with some embodiments of an aspect of the present invention there is provided a combustion system comprising: a combustion chamber having a fuel and oxidant inlet and an exhaust outlet; an oxidant delivery line comprising a compressor and a pressurized oxidant container, which is downstream of the compressor; a fuel delivery line having a fuel source and a fuel feed mechanism; an ignition device for igniting a mixture of the oxidant and fuel in the combustion chamber; a combustion chamber exhaust valve; a coolant line adapted to inject cooling fluid directly into the combustion chamber; a processor for controlling operation of the combustion system; and an energy production device for converting energy from combustion gases and coolant gases exhausted from the combustion chamber.

In some embodiments, the cooling fluid is injected into the combustion chamber after every combustion cycle (i.e. introduction of air and fuel; ignition and combustion; and exhaust). In other embodiments, the cooling fluid is inserted after every two or greater number of cycles; and such choice of cooling interval can be predetermined and controlled by the processor, or controlled by an operator (e.g. engineer). In alternative embodiments, or in combination, the apparatus includes a combustion chamber temperature sensor which provides data to the processor to signal for cooling fluid at appropriate times (temperatures). In some embodiments, the combustion gases are released from the combustion chamber corresponding to the energy demand, i.e. corresponding to the output required by the turbine, including controlling the energy produced to a particular level or particular range.

In some embodiments, the air and/or fuel is introduced (injected) into the combustion chamber in accordance with a preset injection time. In other embodiments, the air and/or fuel is introduced into the combustion chamber in accordance with a pressure of flow measurement.

In accordance with some embodiments of the present combustion system the cooling fluid is provided by the oxidant line; and in some embodiments the oxidant and cooling fluid is air. In some embodiments the system further comprises an auxiliary coolant line adapted to directly feed coolant into the combustion chamber; and in some embodiments the coolant is water. In some embodiments the system further comprises a combustion gas recycle line and a combustion chamber jacket through which recycled combustion gas is fed; and in some embodiments the system comprises a supplementary energy production device. In some embodiments the system further comprises a combustion chamber sensor for providing a data/information to the processor for opening and closing the exhaust valve to control the timing and/or duration of exhaust; and in some of those embodiments that combustion chamber sensor is a pressure sensor and/or a temperature sensor. In some embodiments the system comprises a plurality of combustion chambers and respective exhaust valves.

In accordance with some embodiments of another aspect of the present invention there is provided a method of producing energy, for example electrical energy or heat energy, comprising: injecting fuel and pressurized oxidant into a combustion chamber to form a combustible mixture; igniting the combustible mixture to produce hot combustion gases; allowing or controlling the hot combustion gases to exit the chamber; passing the combustion gases through an energy production device; injecting cooling fluid (e.g. the pressurized oxidant such as air; liquid such as water) into the chamber to cool the chamber and thereby heating the cooling fluid; allowing/controlling the heated cooling fluid to exit the chamber; and passing the heated cooling fluid through the energy production device.

In accordance with some embodiments, the method comprises allowing the hot combustion gases to exit occurs after each igniting of the combustible mixture; while in other embodiments exiting of the hot combustion gases occurs after more than one igniting of the combustible mixture.

BRIEF DESCRIPTION OF THE DRAWINGS

The invention may be understood upon reading of the following detailed description of non-limiting exemplary embodiments thereof, with reference to the following drawings, in which.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Figure 1:
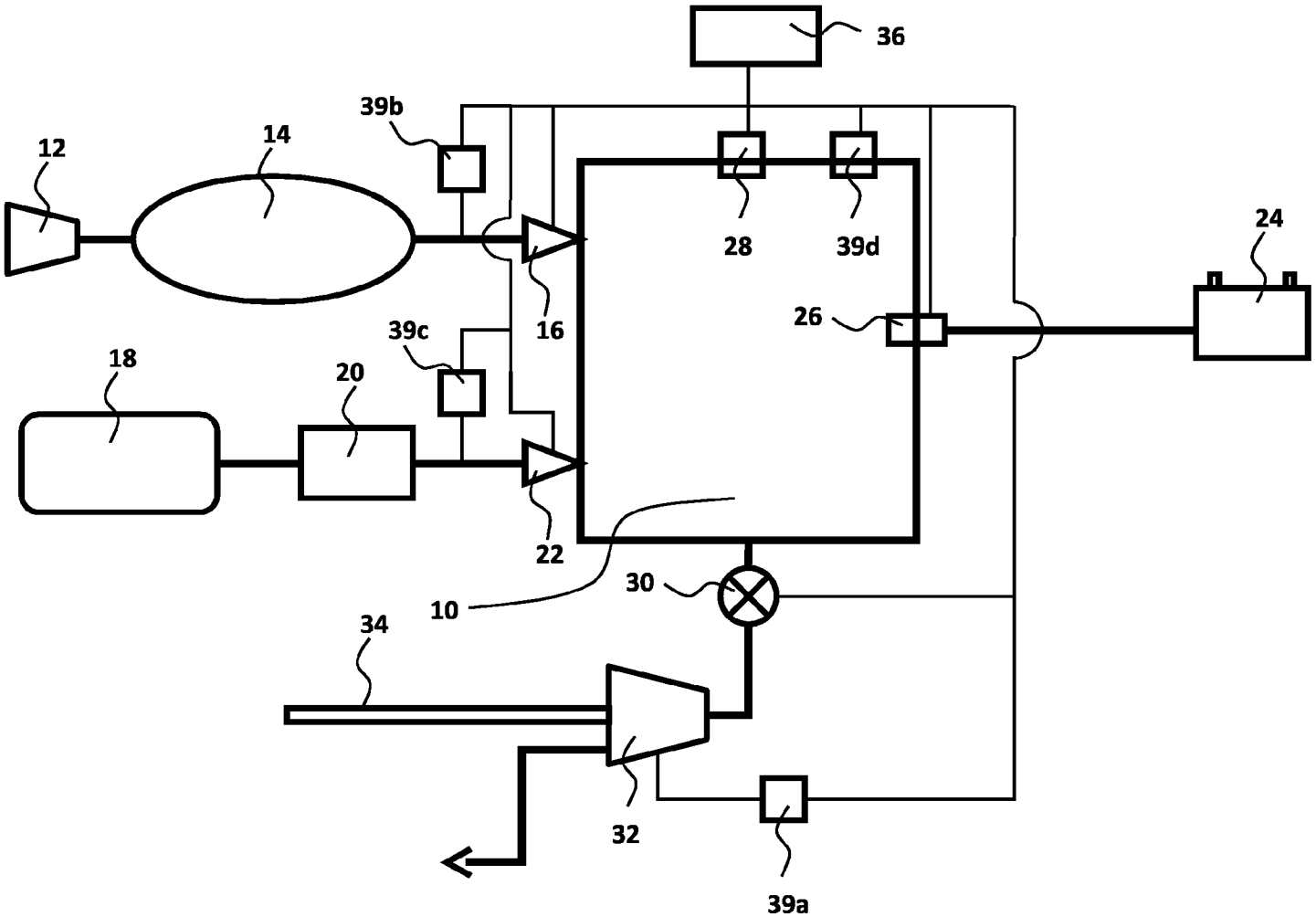
FIG. 1 is a schematic view of a first exemplary embodiment of a combustion system of the present invention.

FIG. 1 shows an embodiment of a combustion system having a combustion chamber 10 into which a fuel line and an oxidant line, for example an air line, are fed, the latter also acting as a cooling fluid delivery system. Air is delivered to combustion chamber 10 via the air line which includes a compressor 12 (or plurality of compressors, typically in series), a pressurized air tank 14 and an air inlet, for example injector 16. Fuel is delivered to combustion chamber 10 via the fuel line which includes a fuel source, for example a fuel tank 18, a fuel feed mechanism such as a fuel pump 20 and a fuel inlet such as injector 22. In some embodiments the air and fuel are introduced via a singular inlet; and in some embodiments, the fuel can be available in the gaseous state.

For igniting the fuel/air mixture in combustion chamber 10, the combustion system further comprises an ignition mechanism, including for example a battery 24 and an ignition means, such as a spark plug 26.

Associated with the combustion chamber 10, there is typically a pressure sensor 28 used to provide information to help determine the proper timing and/or duration for exhausting the combusted gas to an exhaust valve 30; a turbine 32 and a drive shaft 34. An associated processor 36 receives data from a sensor, for example pressure sensor 28, to help control and monitor operation of the system. However, in other embodiments, the sensor 28 is a temperature sensor, for example temperature sensor 39*d* or other appropriate sensor and in still other embodiments the exhaust valve is controlled according to timing. Processor 36 is also typically operably connected to other sensors and valves (e.g. exhaust valve 30 and injectors 16 and 22).

A temperature sensor may be appropriate, for example, when the exhaust gases are intended to be used as a heating medium rather than or in addition to for producing electrical energy. Furthermore, the combustion system would include a temperature sensor if the timing (and/or duration) of cooling fluid input was determined by temperature as compared to input every cycle or number of cycles.

Compressed air from compressor 12 is delivered to pressurized air tank 14 which enters chamber 10 at air injector 16. Fuel from fuel tank 16 is delivered to combustion chamber 10 at fuel injector 20.

In the present embodiment, the combustion chamber 10 is cooled via injection of compressed air into the chamber from the air line; i.e. within the chamber. In other words, from the same air line used to deliver the combustion air source and the air line is also a coolant line.

During operation, battery 24 transmits power to spark plug 26 whereby fuel and air injected into combustion chamber 22 are ignited. Upon reaching a predefined pressure threshold (or maximum pressure, depending upon a suitable algorithm and/or intent), processor 36 signals exhaust valve 30 to open, whereby the combustion gases discharge from combustion chamber 10 into turbine 32 and drive shaft 34.

In some embodiments, the discharge of the combustion gases can occur in more than one step, in order to help keep turbine 32 within a particular rpm range and/or in accordance with a required energy demand. For example, if power is not needed at a specific time, valve 30 will preserve the pressure within combustion chamber 10 until power is needed, and release the combustion gases accordingly.

Then, when pressure sensor 28 senses that the pressure within combustion chamber 10 has reached a predetermined relatively low pressure, which typically occurs after most or essentially all of the combustion gases have been exhausted, processor 36 transmits a signal to re-open the air inlet 38 in order to inject cooling air into combustion chamber 10. This cooling air is thus heated from by the remaining heat from the combustion process that previously occurred. The heating of the cooling air increases the cooling air's pressure in the chamber 10 and again, when the pressure reaches a predefined or maximum level, exhaust valve 30 is opened and this heated air is discharged from combustion chamber 10 to turbine 32 and drive shaft 34.

In some embodiments the system further comprises an rpm sensor/controller 39A in order to preserve a generally constant (or at least particular) rpm rate. This can be important for embodiments of the present combustion system designed to produce electricity, wherein there is a often a relatively constant or range of desired rpm.

In some embodiments the system further comprises an air pressure/flow sensor 39B and/or fuel sensor 39C in order to control the flow of those reactants and/or control the input timing into combustion chamber 10.

Figure 2:
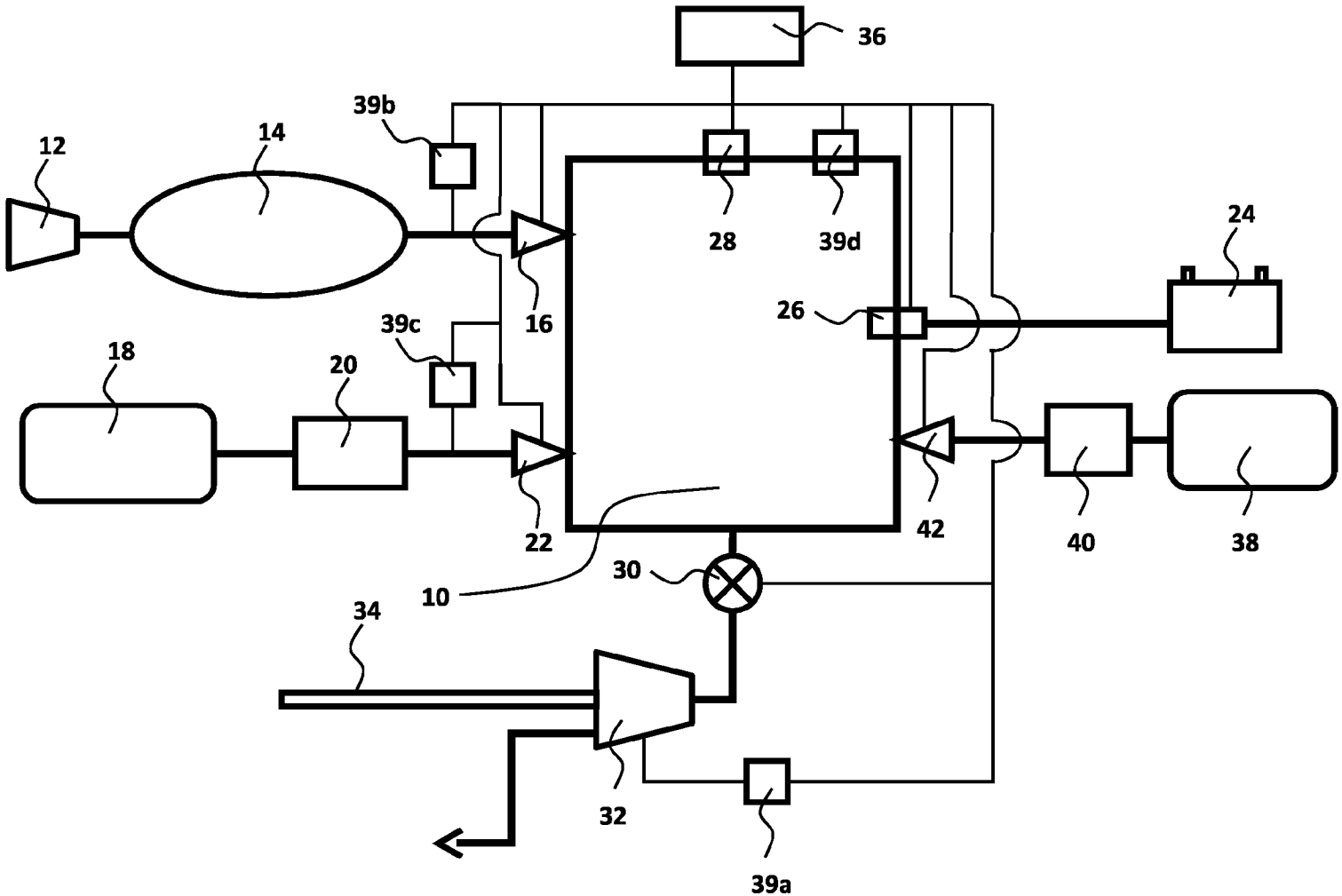
FIG. 2 is a schematic view of another embodiment of the combustion system of the present invention.

FIG. 2 illustrates another exemplary embodiment of the combustion system, which is generally similar to the embodiment depicted in FIG. 1. However, the system further comprises a liquid (typically water) cooling line, which includes a water container 38, a water pump 40 and a water inlet, for example, water injector 42. Water is fed to combustion chamber 10 via water injector 42. The heat remaining within combustion chamber 10 vaporizes the water to produce steam which is then used in a similar manner to the cooling air in the embodiment of FIG. 1, to operate turbine 32 and drive shaft 34.

Figure 3:
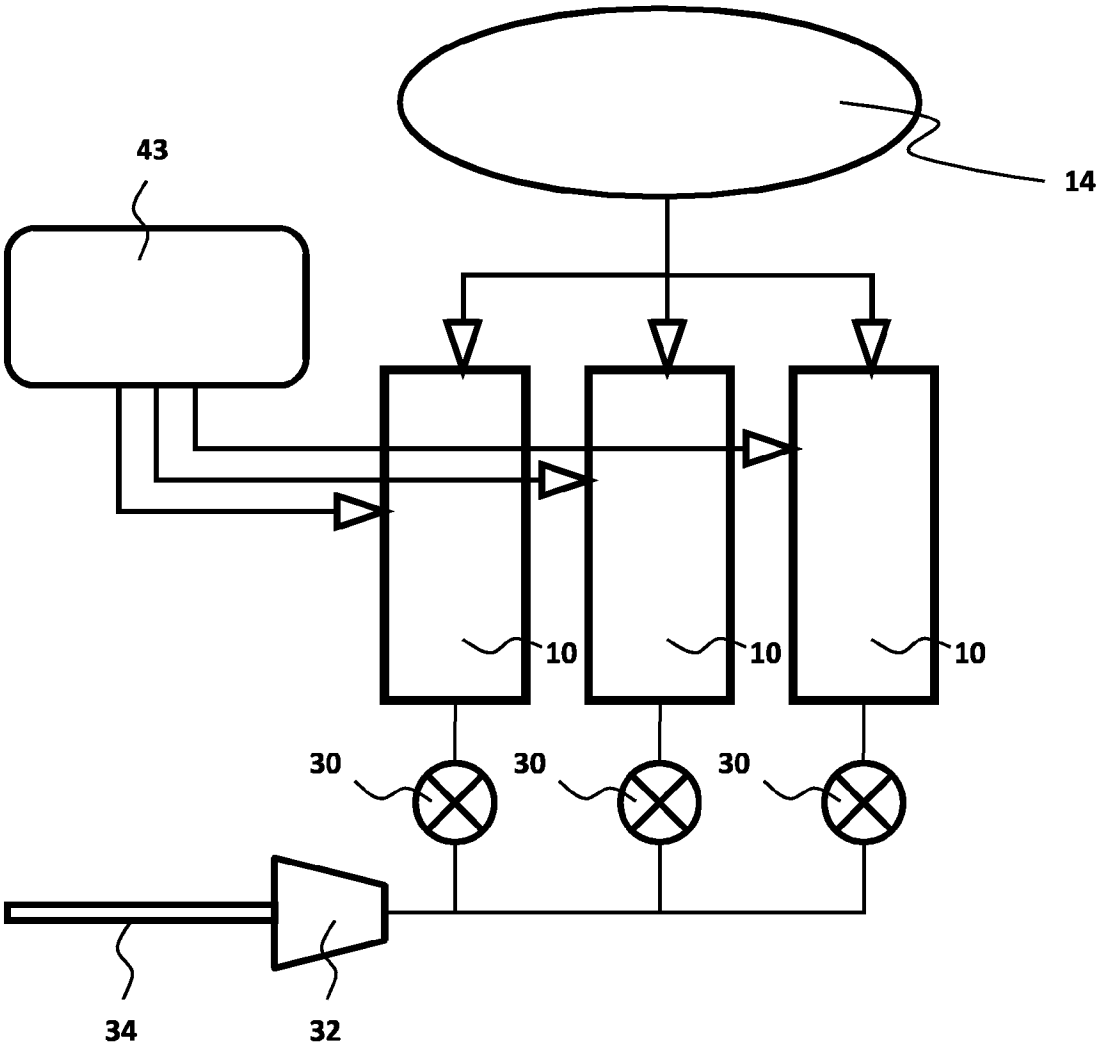
FIG. 3 is a schematic view of yet another embodiment of the combustion system of the present invention.

FIG. 3 shows combustion system comprising a plurality (three shown) of combustion chambers 10, whereby one or more of the chambers can be operated in relation to the demand for energy. Each combustion chamber 10 is fed with air and fuel, schematically represented by container 43, and controlled by processor 36. As before, each of the respective exhaust valves 30 are opened in accordance with a signal from the processor 36, whereby exhaust gases are discharged from each of the combustion chambers 10 to operate turbine 32 and drive shaft 34. As above, optionally, the system further includes a liquid cooling line or use of the air line for cooling the chambers 10 between the repetitive fuel/air combustion.

Figure 4:
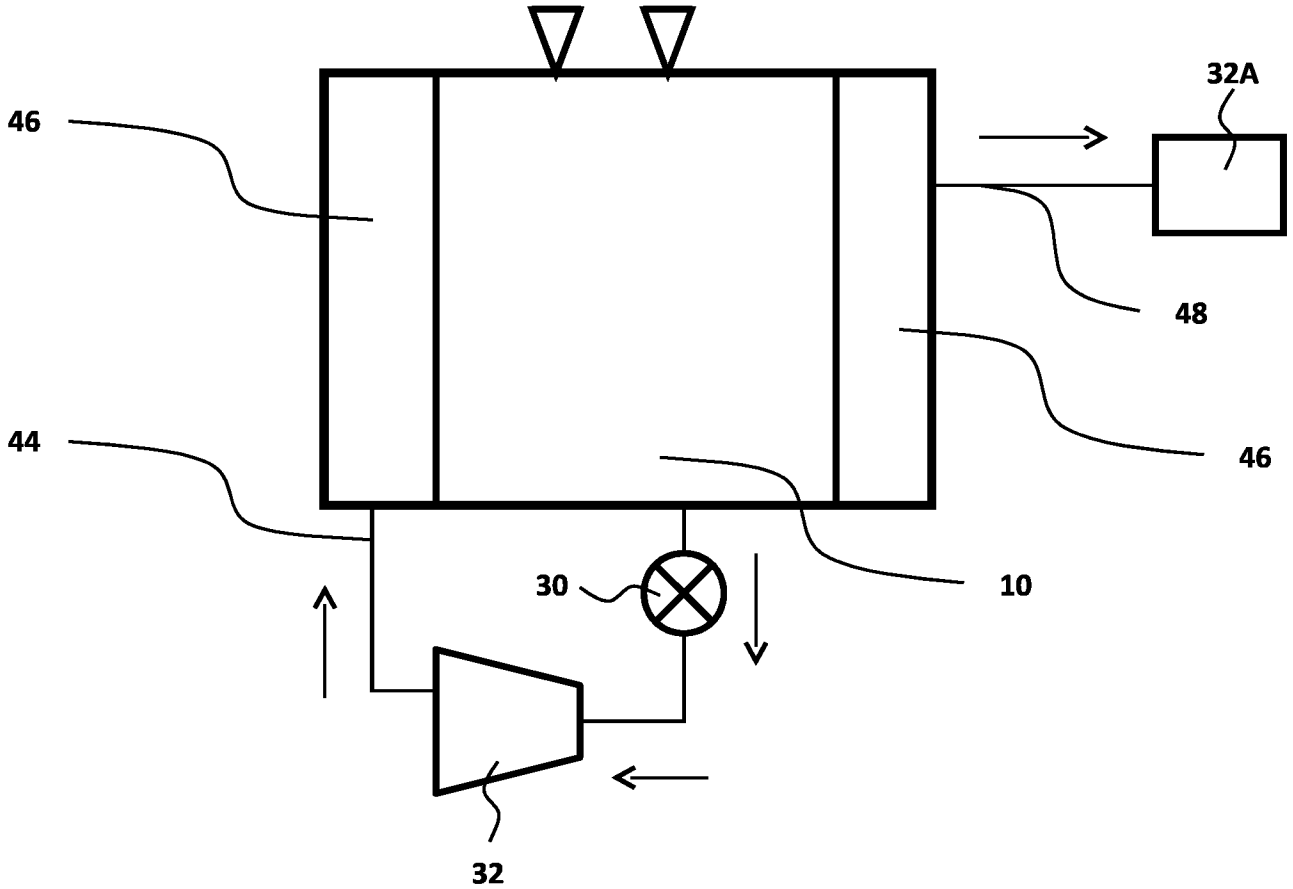
FIG. 4 is a schematic view of still another embodiment of the combustion system of the present invention.

FIG. 4 shows another exemplary embodiment of the combustion system wherein the system further comprises an exhaust gas recycle line 44 utilizing the combustion exhaust gases, and hot air or vapor used for cooling the chamber 10. As seen, those gases (and air or vapor) discharged from turbine 32 are entirely (or in part) recycled to a combustion chamber jacket 46 to both insulate and heat the combustion chamber 10, prior to exhaust through exhaust outlet 48. In some embodiments, the system comprises a supplementary energy production or conversion device, for example a heat exchanger 32*a*.

Figure 5:
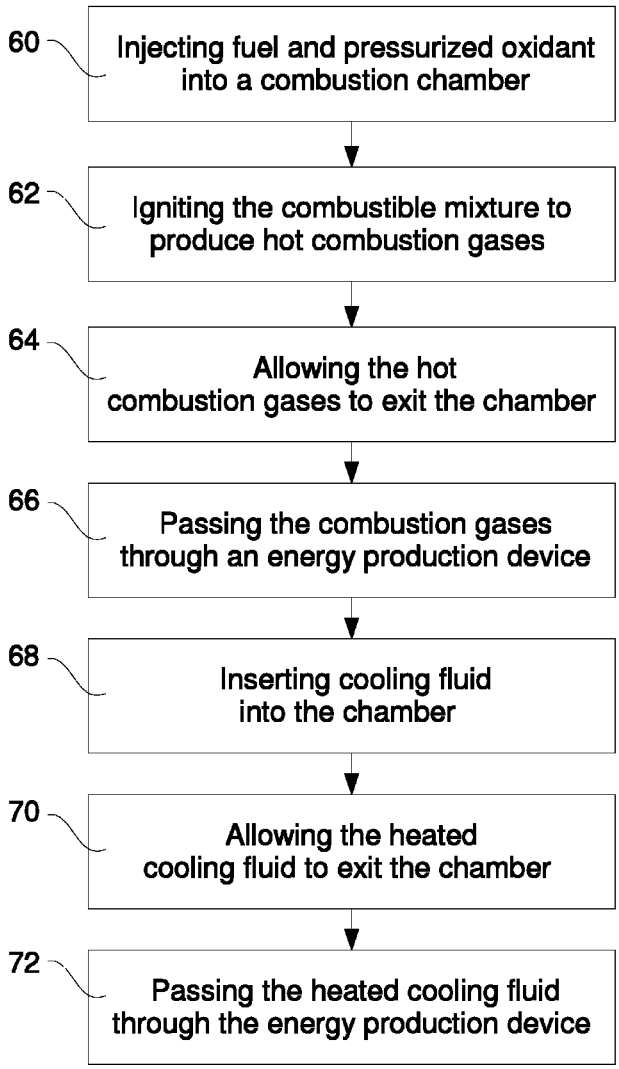
FIG. 5 is a block diagram of an embodiment of a method of combustion according to the present invention.

FIG. 5 depicts an embodiment of a method of operating a combustion system (for example as exemplified by the embodiments described with reference to FIGS. 1-4) comprising: a step 60 of injecting fuel and pressurized oxidant (e.g. air) into a combustion chamber to form a combustible mixture; a step 62 of igniting the combustible mixture to produce hot combustion gases; a step 64 of allowing (controlling) the hot combustion gases to exit the chamber; a step 66 of passing the combustion gases through an energy production device (e.g. turbine, heat exchanger and so forth); a step 68 of injecting/inserting cooling fluid (e.g. oxidant such as air; liquid such as water) into the chamber to cool the chamber and thereby heating the cooling fluid; a step 70 of allowing/controlling the heated cooling fluid to exit the chamber; a step 72 of passing the heated cooling fluid through the energy production device.

In some embodiments of the method, injecting cooling fluid is performed after every cycle of combustion; while in other embodiments, injecting cooling fluid is performed after a plurality of combustion cycles.

In some embodiments, operating the combustion system includes determining the timing and/or duration (amount) of cooling fluid is via measuring the pressure and/or temperature of the chamber. In other embodiments operating the combustion system includes passing the combustion gases and/or heated cooling fluid according to a desired energy level or range, i.e. controlling the timing and/or duration of the aforementioned passing of gases and/or fluid.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A combustion system comprising:

a combustion chamber having a fuel and oxidant inlet and an exhaust outlet;

an oxidant delivery line comprising a compressor and a pressurized oxidant container, which is downstream of the compressor;

a fuel delivery line having a fuel source and a fuel feed mechanism;

an ignition device for igniting a mixture of the oxidant and fuel in the combustion chamber;

a combustion chamber exhaust valve;

a coolant line adapted to inject cooling fluid directly into the combustion chamber;

a processor for controlling operation of the combustion system; and an energy production device for converting energy from combustion gases and coolant gases exhausted from the combustion chamber; wherein the system further comprises a combustion gas recycle line and a combustion chamber jacket through which recycled combustion gas is fed; and further comprises a supplementary energy production or conversion device fed by said recycled combustion gas exiting said combustion chamber jacket.

2. The system according to claim 1, wherein the cooling fluid is provided by the oxidant line.

3. The system according to claim 2, wherein the oxidant and cooling fluid is air.

4. The system according to claim 1, further comprising an auxiliary coolant line adapted to directly feed coolant into the combustion chamber.

5. The system according to claim 4, wherein the coolant fed by the auxiliary coolant line is water.

6. The system according to claim 1, further comprising a combustion chamber sensor for providing data/information to the processor for opening and closing the exhaust valve to control the timing and/or duration of exhaust.

7. The system according to claim 6, wherein the combustion chamber sensor is a pressure sensor.

8. The system according to claim 6, wherein the combustion chamber sensor is a temperature sensor.

9. The system according to claim 1, wherein it comprises a plurality of combustion chambers and respective exhaust valves.

10. The system according to claim 1, wherein the cooling fluid is inserted into the combustion chamber after at least one combustion cycle, the timing of the insertion being predetermined and controlled by the processor.

* * * * *